United States Patent [19]

Snellman et al.

[11] 4,449,706

[45] May 22, 1984

[54] DRIVE SYSTEM FOR A COLLATOR

[75] Inventors: Donald L. Snellman, 2807 W. Galer, Seattle, Wash. 98199; Bernard A. Pearson, King County, Wash.

[73] Assignee: Donald L. Snellman, Seattle, Wash.

[21] Appl. No.: 278,360

[22] Filed: Jun. 29, 1981

[51] Int. Cl.[3] ..... B65H 29/58

[52] U.S. Cl. ..... 271/290; 271/270

[58] Field of Search ..... 271/270, 288, 289, 290; 226/108, 188; 74/15.2, 15.4, 15.63, 15.8

[56] References Cited

U.S. PATENT DOCUMENTS

| | | | |
|---|---|---|---|
| 3,484,101 | 12/1969 | Cassano | 271/290 |
| 3,505,903 | 4/1970 | Grass | 226/188 X |
| 3,701,524 | 10/1972 | Shneider | 271/131 X |
| 3,944,217 | 3/1976 | Greene | 271/289 |

*Primary Examiner*—Richard A. Schacher

*Attorney, Agent, or Firm*—Seed and Berry

[57] ABSTRACT

An improved drive system for a tandem collator obviates the need for multiple motors to drive the various components of the several modules. In a simple manner, the drive train of this invention achieves greater electrical efficiency with reduced maintenance by using a direct current motor to drive a shaft which extends into the primary bin of the primary module and which has coupling means to extend through the primary module into secondary modules attached in tandem. Power takeoff means associated with the line drive shaft power the various elements of each bin, particularly the deflector assembly. A preferred power takeoff includes a plurality of idler and drive sprockets associated with the drive shaft, a driven shaft which is transverse to the drive shaft, and a three-dimensional endless belt which runs between and around the various sprockets.

19 Claims, 2 Drawing Figures

DRIVE SYSTEM FOR A COLLATOR

DESCRIPTION

1. Technical Field

This invention relates to an improved drive system for a collator or a tandem collator which provides greater efficiency for the system. More particularly, the improved drive system obviates the need to have a motor in each module of the collator system, thereby reducing the electric energy required, reducing the maintenance required, and easing the control and tuning necessary to coordinate the modules.

2. Background Art

Ordinarily, in a collator or a tandem collator, a plurality of AC motors are used to drive the various movable parts of the system. Separate motors ensure reliability of the various components of the collator; however, the electrical energy requirements are considerably higher. The multiple motors occupy valuable space in the modules and require considerable time to tune the motors to maintain the speeds of the various collator elements relatively the same. Additionally, AC motors are not as readily adjustable over a wide range of operating speeds, as is desirable. Because the speed of the AC motors are fixed within a small tolerance, it is difficult to match the collator speed to differing feed rates. Faced with increased energy costs and greater demands in flexibility of feeding sheets to a collator, improvements are desirable to the system previously employed.

DISCLOSURE OF INVENTION

The improved drive system for a collator or tandem collator of this invention uses a DC motor to drive the various components of each module through a common line-shaft. Tremendous energy efficiency is obtained by using a DC motor rather than the commonly used AC motors of other collators. With the improved system, one larger motor is mounted in the primary modules of the collator and be used to drive the various components in the primary and secondary modules. The motor is coupled to a drive shaft which extends transversely of the primary module. A power takeoff means is operatively associated with the drive shaft in the primary module to power the primary module, particularly the deflector assembly of the primary module. The collator also includes a sheet-feeding means, sheet-conveying means to convey sheets to a row of trays (forming a bin), and a deflector assembly to deflect the sheets from the sheet-conveying means into the trays. The DC motor is easily controllable over a wide range of motor speeds by regulating the voltage supplied to the motor by suitable means, such as a rheostat, or by more sophisticated means which are sensitive to the load demand placed upon the motor when it drives more bins. By reducing the voltage to the motor, the speed of the motor is reduced and, consequently, the speed of the entire drive system.

The power takeoff means generally includes a driven shaft which is transverse to the drive shaft of that module and is connected to the drive shaft through suitable means. The driven shaft is operatively associated with means which power the components of the module, particularly the deflector assembly. These means, powered by the driven shaft, are common to collator systems of the prior art which were ordinarily powered by a separate AC motor. One takeoff means includes a drive sprocket on the drive shaft, an idler sprocket on the driven shaft, an idler sprocket on the drive shaft, a drive sprocket on the driven shaft, and means for coupling the sprockets to drive the driven shaft from the drive shaft.

In a tandem collator, the drive shaft of the primary module further includes means for coupling the drive shaft to drive a secondary module. The secondary module has a clutch coupled to the drive shaft of the primary module so that the drive shaft of the secondary module can be decoupled from the drive shaft of the primary module. As with the primary module, the drive shaft of the secondary module has a power takeoff means associated with it so that a driven shaft may power the various components of the module, particularly the deflector assembly.

With this system, several collator modules may be placed together and driven from a common DC motor found in the primary mode. Construction costs are reduced. Only one motor need be adjusted to vary the speed of the drive system throughout the entire collator system. Because a DC motor is used, adjustment of the speed of the motor is easily accomplished. Tuning of several motors to match speeds is obviated. The ability to reduce the speed throughout reduces wear and tear on the system parts, reduces power consumption, and reduces the noise. The belted power takeoff means which are preferred accommodate minor variations in location of the various parts of the system so that the modules are powered effectively even if there is slight misalignment.

BEST MODE FOR CARRYING OUT THE INVENTION

Figure 1:
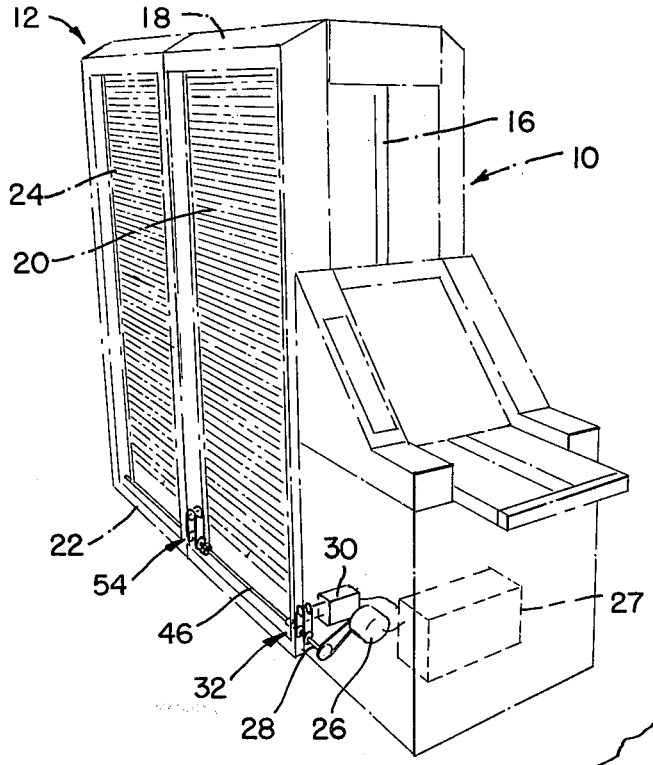
FIG. 1 is a perspective of a tandem collator using the improved drive system of this invention.

FIG. 1 shows a tandem collator having a primary module 10 and a secondary module 12. The primary module 10 includes sheet-feeding means 14, sheet-conveying means 16, and a bin 18 having a row of trays 20 beside which a deflector assembly (not shown) moves upwardly and downwardly to deflect sheets from the conveying means into the trays. Similarly, the secondary module 12 has a bin 22 having a plurality of trays 24 arranged in a vertical row beside which a deflector assembly (not shown) moves upwardly and downwardly to deflect sheets from a conveying means (not shown) into the various trays. The deflector assemblies of the primary module 10 and secondary module 12 are operated by a preferred 0.5-hp, 4.7-amp, 90-volt DC motor 26. A drive shaft 28 is driven by the motor 26 by suitable drive means 30, such as a belt and respective drive wheels on the shaft of the motor and drive shaft. The DC motor 26 includes a speed control means 27, such as a rheostat, to vary the voltage supplied to the motor. A control means 27 which is responsive to the load on the motor 26 is preferred. The drive shaft 28 of the primary module 10 has a power takeoff means operatively associated with it to drive a driven shaft 34. The driven shaft 34 always rotates in one direction; however, through suitable means 36, the driven shaft 34 drives output means, such as shaft 38, in either direction. Deflector assembly sprocket 40 turns both forwardly and backwardly, moving the deflector assembly upwardly and downwardly by means of a deflector assembly chain 42. The driven shaft 34 powers the other components of the module also, such as the sheet conveyor and the pass-over conveyor. In other respects, the modules are similar to modules which use AC motors, except that the driven shaft 34 and associated drive system replaces the AC motor power train. This module power system allows decoupling of all but the pass-over conveyor when the bin has been filled with collated sheets. Thus the power demand for the DC motor is reduced to the minimum power required.

The drive shaft 28 includes a coupling 44 and a coupling shaft 46 to extend the shaft through the primary module 10 and into the secondary module 12. In the secondary module 12, a secondary coupling 48 couples the coupling shaft 46 to the drive shaft 50 of the secondary module 12. To allow the drive shaft 50 of the secondary module 12 to be decoupled from the drive shaft 28 of the primary module 10, a clutch 52 is placed in the drive train. When the clutch is engaged, the drive shaft 50 of the secondary module 12 revolves the drive sprocket 200 of the second module as the drive shaft 28 of the primary module revolves. As with the primary module 10, the secondary module 12 also has a power takeoff means 54 (including the drive sprocket 200) operatively associated with its drive shaft 50. In other respects, the power means 54 for the secondary module 12 is similar to that for the primary module 10.

The power takeoff means 32 preferably includes a drive sprocket 100 on the drive shaft 28, an idler sprocket 102 on the driven shaft 34, an idler sprocket 104 on the drive shaft 28, and, finally, a drive sprocket 106 on the driven shaft 24. A three-dimensional, endless belt connects the four sprockets so that as the drive sprocket 100 of the drive shaft 28 revolves, the drive sprocket 106 of the driven shaft 34 is also rotated.

Figure 2:
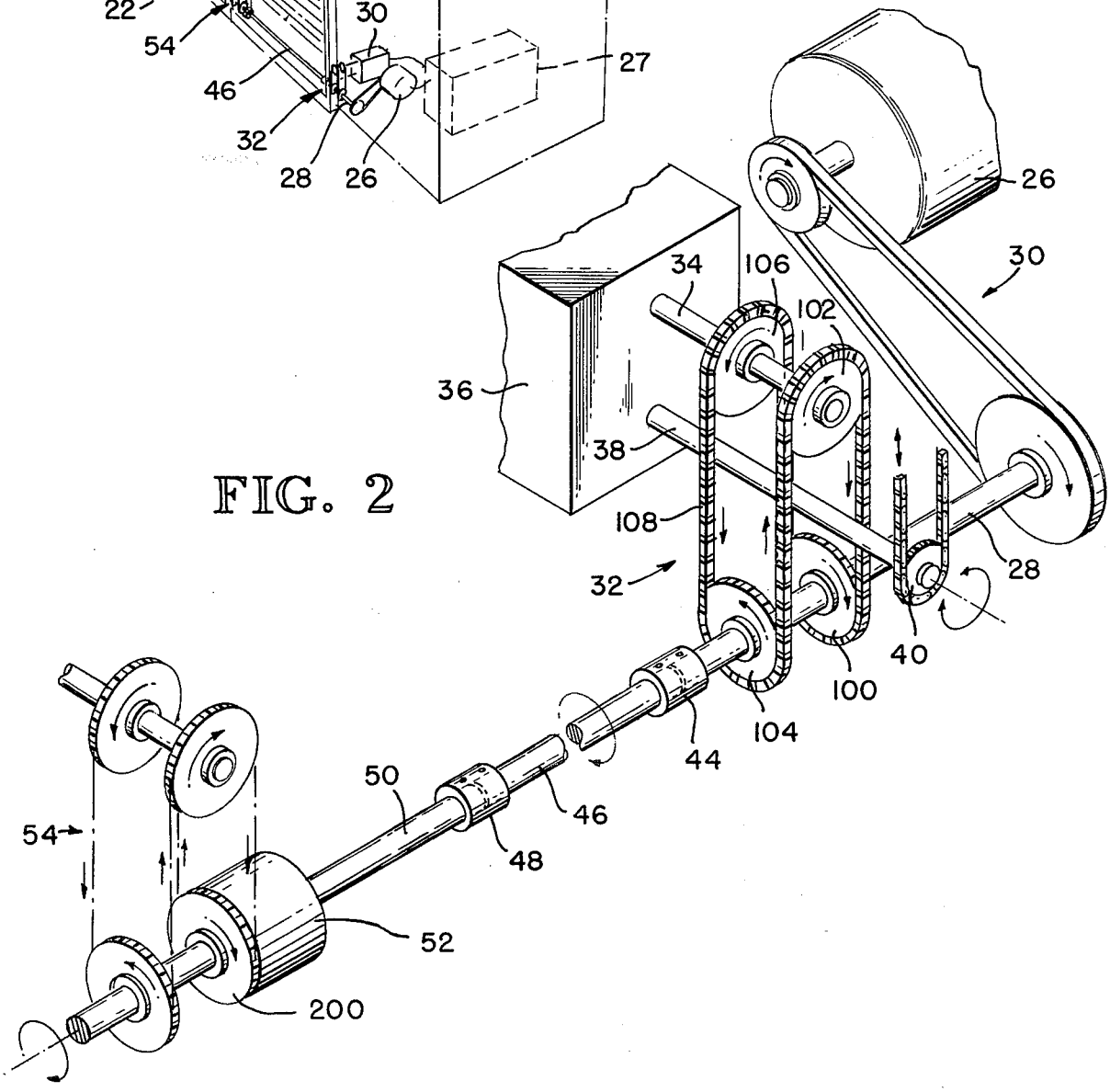
FIG. 2 is a partially schematic isometric showing the improved driven system of this invention.

The arrows in FIG. 2 show the direction of rotation of the various sprockets. Use of the preferred power takeoff of this invention allows for greater tolerance in positioning of the shafts during the construction of the collator system over beveled gears, for example. While other power takeoff means may be used, the sprocket and belt system just described is highly preferred because of its simplicity and utility.

We claim:

1. In a collator having sheet-feeding means, sheet-conveying means, a row of trays forming a bin unit to receive collated sheets, and a deflector assembly to deflect sheets from the sheet-conveying means into the trays, the improvement to the drive system of the collator comprising:

(a) a direct current motor having a power output shaft;

(b) a drive shaft for powering components of the collator including at least one sprocket;

(c) means for coupling the output shaft of the motor to the drive shaft; and (d) a power takeoff operatively associated with the sprocket of the drive shaft to power the components when the output shaft of the motor turns, the takeoff including a driven sprocket on a driven shaft and a three-dimensional endless belt to couple the sprocket of the drive shaft to the driven sprocket of the driven shaft; wherein the three-dimensional belt engages the sprocket of the drive shaft in a first plane and engages the driven sprocket in a plane substantially orthogonal to the first plane, without twisting of the belt.

2. The improved drive system of claim 1, further comprising a controller to vary the speed of the output shaft of the motor and consequently the speed of the entire drive system.

3. The improved drive system of claim 2 wherein the power takeoff has:

(a) the driven shaft positioned transversely to the drive shaft; and (b) means operatively associated with the driven shaft to power the bin components.

4. The collator drive system of claim 3 wherein the drive shaft has two spaced sprockets and the driven shaft has two spaced sprockets, the driven shaft being substantially perpendicular to the drive shaft, and wherein the belt engages the four sprockets to couple the drive shaft and driven shaft.

5. In a collator having sheet-feeding means, sheet-conveying means, a row of trays forming a bin unit to receive collated sheets, and a movable deflector assembly to deflect sheets from the sheet-conveying means into the trays, the improvement to the drive system of the collator comprising:

(a) a direct current motor having an output shaft;

(b) a drive shaft;

(c) means for coupling the output shaft of the motor to the drive shaft;

(d) control means to vary the speed of the motor and consequently the speed of the entire drive system; and (e) power takeoff means operatively associated with the drive shaft to power the components in the module when the motor turns, including:

(i) a driven shaft transverse to the drive shaft;

(ii) means to turn the driven shaft when the drive shaft turns, including a three-dimensional endless belt coupling the driven shaft and drive shaft, and at least one sprocket on the drive shaft and one sprocket on the driven shaft over which the belt passes; and (iii) means operatively associated with the driven shaft to power the components in the module;

wherein the three-dimensional belt, without twisting, engages the sprocket of the drive shaft in a first plane and engages the sprocket of the driven shaft in a plane substantially orthogonal to the first plane.

6. In a tandem collator having (I) a primary module including sheet-feeding means, sheet-conveying means, a row of trays forming a bin unit to receive collated sheets, and a first movable deflector assembly to deflect sheets from the sheet-conveying means into the trays, and (II) at least one secondary module including sheet-conveying means, a row of trays forming a bin unit to receive collated sheets, and a second movable deflector assembly, the improvement in the drive system comprising:

in the primary module (a) a direct current motor having a power output shaft;

(b) a drive shaft powering the module;

(c) means for coupling the output shaft of the motor to the drive shaft;

(d) a primary power takeoff operatively associated with the drive shaft to power the primary module, including a three-dimensional endless belt to couple the drive shaft to a driven shaft of the takeoff; and (e) a coupling to link the drive shaft of the primary module to the secondary module; and in each secondary module (a) a secondary drive shaft operatively associated with the coupling of the drive shaft of the primary module; and (b) a secondary power takeoff operatively associated with the drive shaft to power the secondary module, including a clutch to allow selective activation and deactivation of the secondary power takeoff at predetermined intervals, wherein the primary power takeoff or the combination of the primary and secondary power takeoffs may be activated at one time to allow efficient power consumption during collating, and wherein the three-dimensional belt engages a sprocket of the drive shaft in a first plane and engages a sprocket of the driven shaft in a plane substantially orthogonal to the first plane, without twisting of the belt.

7. The improved drive system of claim 6, further comprising control means to vary the speed of the motor and consequently the speed of the entire drive system in both the primary and secondary modules.

8. The collator drive system of claim 6 wherein the clutch of the secondary power takeoff is connected to a sprocket which otherwise idles on the secondary drive shaft, the clutch coupling the sprocket to the secondary drive shaft at predetermined intervals.

9. The collator drive system of claim 8 wherein the secondary power takeoff further includes a three-dimensional endless belt which engages the sprocket and which connects the sprocket with a driven shaft.

10. In a tandem collator having (1) a primary module including sheet-feeding means, sheet-conveying means, a row of trays forming a bin unit to receive collated sheets, and a first movable deflector assembly to deflect sheets from the sheet-conveying means into the trays, and (II) at least one secondary module including sheet-conveying means, a row of trays in a bin to receive collated sheets, and a second movable deflector assembly, the improvement in the drive system comprising:

in the primary module (a) a motor having a power output shaft;

(b) a controller to vary the speed of the motor and consequently the speed of the entire drive system in both the primary and secondary modules;

(c) a drive shaft extending into the primary module to power the module;

(d) means for coupling the output shaft of the motor to the drive shaft so that the shaft turns when the motor turns;

(e) a primary power takeoff operatively associated with the drive shaft to power the primary module, the takeoff including a three-dimensional endless belt; and (f) a coupling to link the drive shaft of the primary module to the secondary module; and in each secondary module;

(a) a secondary drive shaft operatively associated with for coupling of the drive shaft of the primary module;

(b) a clutch operatively associated with the secondary drive shaft and a secondary power takeoff to decouple the secondary module from the primary module; and (c) a secondary power takeoff operatively associated with the secondary drive shaft and clutch to power the secondary module, being decoupled from the secondary drive shaft by the clutch at predetermined intervals, the secondary power takeoff including a three-dimensional endless belt to interconnect the secondary drive shaft and a driven shaft in the secondary module, wherein each belt engages a sprocket of the drive shaft in a first plane and a sprocket of the driven shaft in a plane substantially orthogonal to the first plane, without twisting of the belt.

11. The collator drive system of claim 10 wherein the primary power takeoff further includes two spaced sprockets on the drive shaft, a driven shaft substantially perpendicular to the drive shaft, and two spaced sprockets on the driven shaft, and wherein the belt engages the four sprockets to couple the drive shaft to the driven shaft.

12. The collator drive system of claim 11 wherein the secondary power takeoff further includes two spaced sprockets on the secondary drive shft, a secondary driven shaft substantially perpendicular to the secondary drive shaft, and two spaced sprockets on the secondary driven shaft, and wherein the belt engages the four sprockets to couple the secondary drive shaft to the secondary driven shaft.

13. The collator drive system of claim 12 wherein the clutch is connected to one sprocket which otherwise idles on the secondary drive shaft and wherein the second sprocket always idles on the secondary drive shaft so that the secondary power takeoff is decoupled from the secondary drive shaft until the clutch engages the secondary drive shaft.

14. The collator drive system of claim 10 wherein the secondary power takeoff further includes an idler sprocket on the secondary drive shaft and wherein the clutch is connected to the sprocket to couple the sprocket to the secondary drive shaft at predetermined intervals.

15. In a collator having sheet-feeding means, sheet-conveying means, a row of trays forming a bin unit to receive collated sheets, and a deflector assembly to deflect sheets from the sheet-conveying means into the trays, the improvement to the drive system of the collator comprising:

(a) a direct current motor having a power output shaft;

(b) a drive shaft for powering components of the collator;

(c) means for coupling the output shaft of the motor to the drive shaft;

(d) a power takeoff operatively associated with the drive shaft to power the components when the output shaft of the motor turns, the take-off including a three-dimensional endless belt to couple the drive shaft to a driven shaft; and (e) a controller to vary the speed of the output shaft of the motor and consequently the speed of the entire drive system, wherein the power takeoff has the driven shaft positioned transversely to the drive shaft, and has means operatively associated with the driven shaft to power the bin components, and wherein the drive shaft has two spaced sprockets and the driven shaft has two spaced sprockets, the driven shaft being substantially perpendicular to the drive shaft, and wherein the belt engages the four sprockets to couple the drive shaft and driven shaft.

16. In a tandem collator having (I) a primary module including sheet-feeding means, sheet-conveying means, a row of trays forming a bin unit to receive collated sheets, and a first movable deflector assembly to deflect sheets from the sheet-conveying means into the trays, and (II) at least one secondary module including sheet-conveying means, a row of trays in a bin to receive collated sheets, and a second movable deflector assembly, the improvement in the drive system comprising:

in the primary module (a) a motor having a power output shaft;

(b) a controller to vary the speed of the motor and consequently the speed of the entire drive system in both the primary and secondary modules;

(c) a drive shaft extending into the primary module to power the module;

(d) means for coupling the output shaft of the motor to the drive shaft so that the shaft turns when the motor turns;

(e) a primary power takeoff operatively associated with the drive shaft to power the primary module, the takeoff including an endless belt; and (f) a coupling to link the drive shaft of the primary module to the secondary module; and in each secondary module (a) a secondary drive shaft operatively associated with for coupling of the drive shaft of the primary module;

(b) a clutch operatively associated with the secondary drive shaft and a secondary power takeoff to decouple the secondary module from the primary module; and (c) a secondary power takeoff operatively associated with the secondary drive shaft and clutch to power the secondary module, being decoupled from the secondary drive shaft by the clutch at predetermined intervals, the secondary power takeoff including an endless belt to interconnect the secondary drive shaft and a driven shaft in the secondary module, wherein the primary power takeoff further includes two spaced sprockets on the drive shaft, a driven shaft substantially perpendicular to the drive shaft, and two spaced sprockets on the driven shaft, and wherein the belt engages the four sprockets to couple the drive shaft to the driven shaft.

17. The collator drive system of claim 16, wherein the secondary power takeoff further includes two spaced sprockets on the secondary drive shaft, a secondary driven shaftt substantially perpendicular to the secondary driven shaft, and wherein the belt engages the four sprockets to couple the secondary drive shaft to the secondary driven shaft.

18. The collector drive system of claim 17 wherein the clutch is connected to one sprocket which otherwise idles on the secondary drive shaft and wherein the second sprocket always idles on the secondary drive shaft so that the secondary power takeoff is decoupled from the secondry drive shaft until the clutch engages the secondary drive shaft.

19. The collator drive system of claim 16 wherein the secondary power takeoff further includes an idler sprocket on the secondary drive shaft and wherein the clutch is connected to the sprocket to couple the sprocket to the secondary drive shaft at predetermined intervals.

* * * * *